United States Patent [19]

Cotton

[11] 4,083,118

[45] Apr. 11, 1978

[54] TIME-AND-TEMPERATURE DRYER CONTROL

[75] Inventor: Curran D. Cotton, Newton, Iowa

[73] Assignee: The Maytag Company, Newton, Iowa

[21] Appl. No.: 720,693

[22] Filed: Sep. 7, 1976

[51] Int. Cl.[2] ..... F26B 19/00

[52] U.S. Cl. ..... 34/53; 34/48; 219/492

[58] Field of Search ..... 34/44, 45, 48, 53; 219/492

[56] References Cited

U.S. PATENT DOCUMENTS

| | | | |
|---|---|---|---|
| 2,838,845 | 6/1958 | Erickson | 34/133 |
| 2,863,224 | 12/1958 | Zehrbach | 34/133 |
| 3,186,107 | 6/1965 | Raley | 34/53 |
| 3,213,548 | 10/1965 | Deaton | 34/53 |
| 3,510,957 | 5/1970 | Jarvis | 34/53 |

*Primary Examiner*—John J. Camby

*Assistant Examiner*—Larry I. Schwartz

*Attorney, Agent, or Firm*—Richard L. Ward

[57] ABSTRACT

A control system for a fabric drying apparatus comprising a resistive heating element in series with high limit and cycling thermostats and connected across the two power lines of a three wire alternating current power supply. The drive motor of the timer is electrically connected between the junction of two legs of the heating circuit and the neutral wire of the power supply. The impedance of the timer drive motor is high compared to the resistance of the heating element; therefore, when the heating element is energized for dying fabrics, the current flow to the timer drive motor is negligible and the timer will not advance. When the cycling thermostat in one of the legs opens at a predetermined temperature, the heating element will be deenergized and current will flow in the other leg and neutral line and the timer will advance until the thermostat closes to reenergize the heating element.

8 Claims, 2 Drawing Figures

10
11
12
13
14
15
16
19
20
21
22
23
24
25
26
29
30
31
32
33
34
35
36
37
39
40
41
42
43
44
45
46
49
50
51
52
53
54
55
56
58
60
61
62
63
64
65
66
69
89
90

TIME-AND-TEMPERATURE DRYER CONTROL

BACKGROUND OF THE INVENTION

1. Field of the Invention

This invention is related generally to a drying apparatus and more particularly to a system for terminating the operation of the apparatus.

2. Description of the Prior Art

Time-and-temperature dryer controls generally have at least one cycling thermostat which senses the exhaust air temperature and when this temperature rises above a first predetermined value the thermostat operates to deenergize the heating element. When the exhaust temperature drops below a second predetermined value the thermostat operates to reenergize the heating element. The circuitry is arranged so that during periods of heater-off operation the dryer continues to tumble the fabrics and the timer drive motor is energized to advance the timer toward an off position. This cycling operation continues until the timer has advanced through a predetermined period of time to an off position.

Prior art time-and-temperature dryer controls effectively isolate the timer motor circuit from the heater circuit. Usually, as in the U.S. Pat. Nos. 3,302,299 and 3,510,957, the timer operates, when the heater shuts off, through "back contacts" associated with the thermostats.

There have been many constructions such as found in U.S. Pat. Nos. 2,838,845 and 2,863,224 where the heating element is center-tapped to control the heater wattage but these constructions do not relate to time-and-temperature dryer controls.

SUMMARY OF THE INVENTION

It is an object of the instant invention to provide an improved time-and-temperature control circuit for a fabric drying apparatus.

It is a further object of the instant invention to integrate the heater and sequential control circuits into one common circuit.

It is a still further object of the instant invention to advance the sequential control toward an off position whenever the heater circuit is interrupted.

These objects are achieved in an electrical control circuit for a fabric drying apparatus which has an electrical heating element with an intermediate electrical tap forming a heating circuit having first and second heater legs. The power supply to the apparatus is a standard three-wire alternating current power supply with the electric heating element connected across the two power lines. Cycling and high limit thermostats are connected in series with the heating element in the first heater leg. One lead of a timer or sequential control motor is connected to the intermediate electrical tap on the heating element with the other lead connected to the neutral line of the power supply. When the dryer is energized, current flow in the neutral line is negligible since the resistance of the heating element is small compared to the impedance of the timer motor. At a predetermined temperature the cycling thermostat will open the first leg of the heater circuit to terminate operation of the heater; at this time current will flow in the neutral line and in the second leg of the heating circuit and the timer will advance toward an off position with the drive motor continuing to tumble the fabrics. The apparatus will continue to operate under control of the cycling thermostat and sequential control until the sequential control advances to the off position.

Operation of the device and further objects and advantages thereof will become evident as the description proceeds and from an examination of the accompanying two pages of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
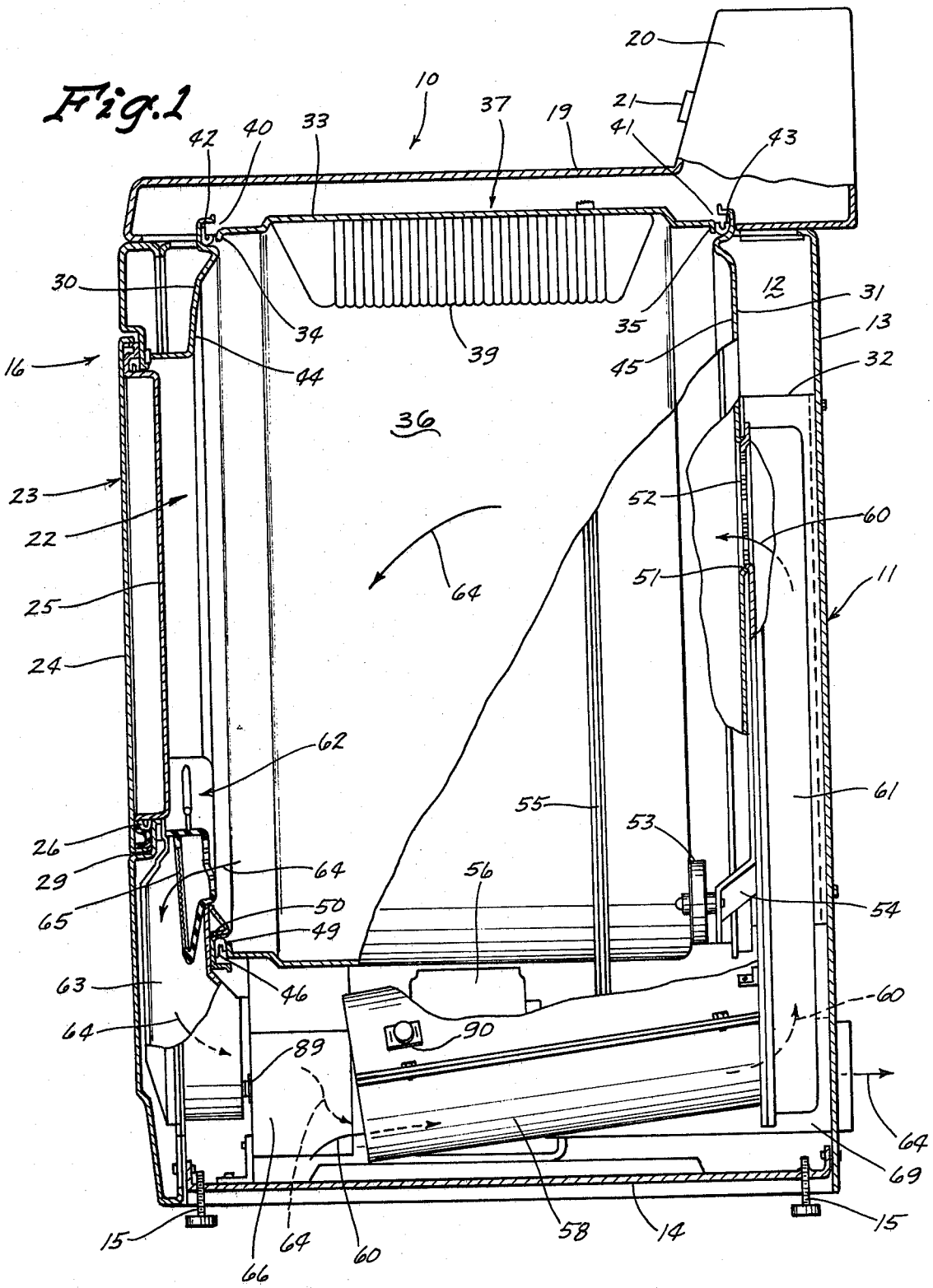
FIG. 1 is a view of a fabric drying apparatus partially broken away in section and incorporating the control system of the instant invention.

Referring to FIG. 1 there is shown the overall construction for a clothes dryer 10 including a cabinet assembly comprising a side wall wrapper 11 having generally vertical opposite side panels 12 and an integral rear panel 13. The side wall wrapper 11 is supported on a base 14 which in turn is supported on a horizontal surface through a plurality of adjustable feet 15. The cabinet assembly further comprises a front panel 16 and top cover 19 supported on the side wall wrapper 11. The top cover 19 includes an upwardly extending housing 20 for accommodating selected controls for the dryer such as a push-to-start mechanism incorporated into a timer or sequential control and operated by a button 21.

The front panel 16 defines a generally central access opening 22 and includes a door 23 hinged on the front panel 16 and operable between open and closed positions relative to the access opening 22. The door 23 includes an outer panel 24 substantially flush with the front panel 16 and an inner panel 25 having a portion that extends rearwardly into the access opening 22. A seal 26 supported by the inner panel 25 extends endlessly around the rearwardly extending portion of the inner panel 25 for engagement with a recessed portion 29 of the front panel 16 to effectively provide an air seal at the access opening 22.

Disposed within the cabinet assembly is a pair of spaced apart generally vertical bulkheads 30 and 31. The rear bulkhead 31 is fixed to the side wall wrapper 11 by a pair of brackets such as the bracket 32 that includes a front flange connected to the bulkhead 31 and a rear flange connected to the rear panel 13. The front bulkhead 30 is similarly connected to the front flanges of wrapper 11 with a pair of brackets (not shown).

A fabric tumbler 37 with a generally cylindrical peripheral side wall 33 having a substantially horizontal axis is disposed between the stationary bulkheads 30 and 31. At the front and at the rear of the peripheral side wall 33 there are inwardly turned flanges comprising relatively short end walls 34 and 35 juxtaposed the front and rear bulkheads 30 and 31 and cooperable with the peripheral side wall 33 to effectively define a drying chamber 36. A plurality of baffle members 39 are fixed to the peripheral side wall 33 and extend into the drying chamber 36 for assisting in the movement of fabrics therewithin during rotation of the fabric tumbler 37.

The front and rear bulkheads 30 and 31 include radially outwardly disposed recess portions 40 and 41 facing axially toward the rear and toward the front, respectively, of the dryer 10. Seals 42 and 43 are fixed to the bulkheads 30 and 31 in the recesses 40 and 41 and are engageable with the end walls 34 and 35 to provide an air seal at the ends of the drying chamber 36. The bulkheads 30 and 31 also include generally annular portions 44 and 45 inwardly disposed from the recesses 40 and 41 that effectively provide extensions of the end walls 34 and 35.

The seal member 42 disposed between the front stationary bulkhead 30 and the rotatable fabric tumbler 37, for example, is shown as a U-shaped or channel-shaped felt member having a pair of generally outwardly extending legs 46 and 49 connected by an intermediate arcuate portion. The leg 46 is fixed, as with adhesive, to the stationary bulkhead 30 in the recess 40 so that the intermediate arcuate portion conforms generally to the corner radius 50 and effectively biases the other leg 49 into engagement with the front wall 34 of the fabric tumbler 37. The felt may be coated on one side with an anti-friction layer such as polytetrafluoroethylene to provide a smooth, more durable, and lower friction running surface for engagement with the end wall 34. A similar seal is provided at the rear bulkhead 31.

The front bulkhead 30 defines an access into the drying chamber 36 that is substantially aligned with the access opening 22 in the front panel 16. The rear bulkhead 31 defines an opening 51 to receive a perforate panel 52 through which airflow is directed into the drying chamber 36 from a duct system as will be shown.

The fabric tumbler 37 is supported on a generally horizontal axis by a system including a pair of rollers 53 supported on brackets 54 fixed to the rear bulkhead 31 and by a pair of slide bearings (not shown) supported by similar brackets fixed to the front bulkhead 30. The fabric tumbler 37 could be supported entirely on rollers 53 or entirely on slides as conditions permit.

The fabric tumbler 37 is rotated by a belt 55 encompassing the periphery of the cylindrical tumbler side wall 33 and driven by a motor 56 mounted on the base 14.

The airflow system for the clothes dryer 10 includes a heater assembly 58 supported adjacent the base 14 and into which air is drawn from the atmosphere for heating prior to movement into the fabric drying chamber 36. Airflow from the atmosphere through the heater assembly 58 and into the drying chamber 36 is shown by arrows numbered 60. The heater assembly 58 accommodates an electric heating element 59 as will be considered in greater detail as related to the control circuitry of FIG. 2. The heater assembly 58 is connected to a generally upwardly extending rear air duct 61 which conducts heated air from the heater assembly 58 through the rear perforate panel 52 and into the drying chamber 36.

The air then flows from the drying chamber 36 through a filter assembly 62 into the front air duct 63. Airflow from the drying chamber 36 is shown by arrows numbered 64. The filter assembly 62 includes a filter screen 65 supported within the front air duct 63 for removing lint particles from the air flowing out of the drying chamber 36 into the front air duct 63.

The air is drawn from the front air duct 63 into a blower assembly 66 from which it is forced through a rearwardly extending lower air duct 69 to atmosphere. The blower 66 includes an impeller (not shown) that is driven by the motor 56 mounted adjacent to the blower 66 on the base 14.

Figure 2:
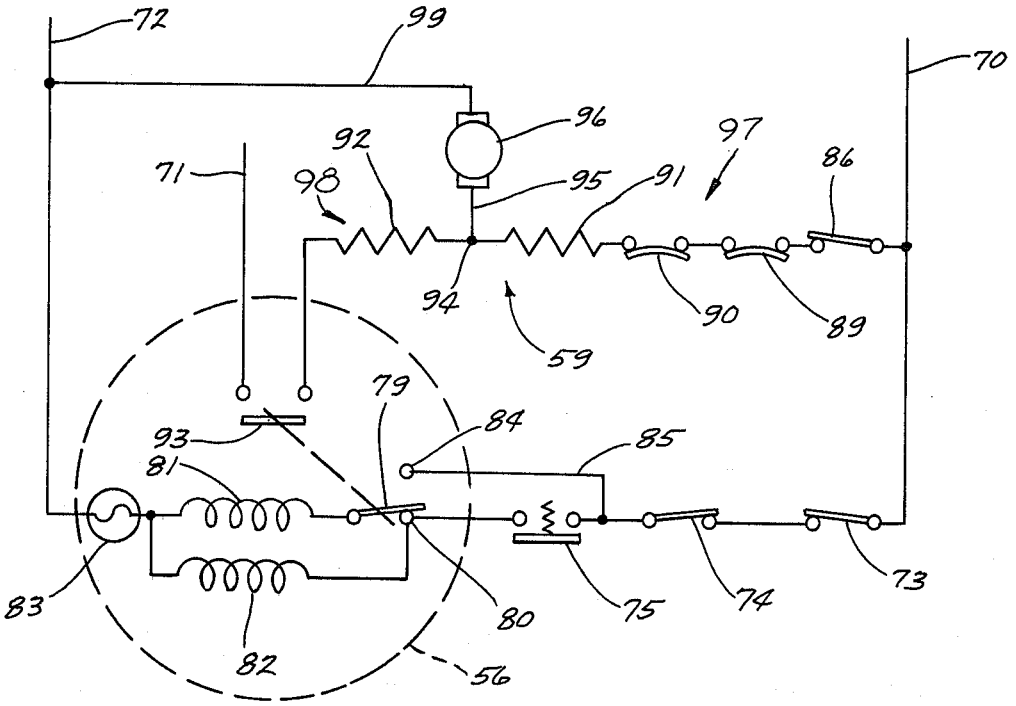
FIG. 2 is an electrical schematic diagram of the control circuit of the instant invention.

Referring now to FIG. 2, the control circuitry includes three conductors that are connectable with a conventional three-wire 240 volt, alternating current supply. For the explanation of the circuitry of FIG. 2, it will be assumed that conductors 70 and 71 are connected with the power lines and that the conductor neutral 72 is connected to the earth-grounded neutral line.

The drive motor energizing circuit for the clothes dryer 10 operates on 120 volts and includes a door switch 73 connected to conductor 70, a timer contact 74 and a manually actuatable momentary single-pole single-throw switch mechanism 75 incorporated into the timer and operated by push-to-start button 21 as shown in FIG. 1. The circuit continues through centrifugal switch 79 made to contact 80 within the motor 56, run and start windings 81 and 82, and thermal protector 83 to neutral 72.

Until the motor 56 rotates at a predetermined speed, the run and start windings 81 and 82 are both energized through centrifugal switch 79 made to contact 80, but upon operation of the centrifugal switch 79 to the normally open contact 84 the start winding 82 is disconnected from the circuit. After initial energization of the motor 56 and operation of the centrifugal switch 79 to the normally open contact 84 and release of the push-to-start button 21, the circuit for energizing the motor 56 and maintaining energization thereof will be complete from the first power conductor 70 through the door switch 73, timer contact 74 and a conductor 85 to the normally open contact 84 of the centrifugal switch 79.

As further shown in FIG. 2, the heating circuit extends between power lines 70 and 71 and operates on 240 volts. The heating circuit includes a timer contact 86, at least one cycling thermostat 89 mounted on the blower assembly 66, a high-limit thermostat 90 secured to the heater assembly 58, a heating element 59 having first and second series connected portions or coils 91 and 92 and a centrifugal switch 93 within the drive motor 56.

Electrically connected to the junction 94 of the first and second coils 91 and 92 of the heating element 59 is one lead 95 of the drive motor 96 for the timer or sequential control. The other lead 99 extends to the neutral line 72 of the power supply. The heating circuit is thus divided into two legs 97 and 98 with the first leg 97 extending from conductor 70 to junction 94 and including contact 86, thermostats 89 and 90 and heater coil 91. The second leg 98 extends from junction 94 through coil 92 and centrifugal switch 93 to conductor 71.

The function of the cycling thermostat 89 in the first heater leg 97 is to maintain the drying chamber 36 at the proper drying temperature. This is accomplished by the cycling thermostat 89 opening at a first predetermined temperature, in the range of 140° to 150° F., to deenergize the heater element 59 and closing at a second predetermined temperature, generally 10° F. lower than the first temperature, to reenergize the heating element 59. The high-limit thermostat 90 deenergizes the heating element 59 in case the temperature should rise above a temperature of 170° F. as with insufficient airflow through the drying chamber 36.

In operation, after the drive motor 56 has been energized, a second centrifugal switch 93 is simultaneously closed as the first centrifugal switch 79 is made to the normally open contact 84. Closure of this second centrifugal switch 93 along with the closing of timer contact 86 serves to complete the heating circuit from conductor 70 through timer contact 86, cycling thermostat 89, a high-limit thermostat 90, heating element 59 and the second centrifugal switch 93 to conductor 71.

In a particular example, when the heating element 59 is energized with the timer motor 96 electrically connected at an intermediate point or junction 94 between first and second coils 91 and 92 of the heating element 59, the voltage drop across the timer motor 96 between the intermediate connection 94 and the neutral line 72 will be substantially less than 50 volts since the windings of the motor 96 present an impedance in the magnitude of 4000 ohms compared to a resistance of 10 ohms for the heating element 59. This voltage drop across the timer motor 96 is not sufficient to start the timer motor 96 and the timer will not advance when the heating element 59 is energized.

Since the timer motor 96 will start and run at 60 volts, the intermediate connecting point 94 for the timer motor 96 between the first and second heating element coils 91 and 92 is chosen so that the voltage drop across the timer motor 96 when the heating element 59 is energized will be in the area of 50 volts or less. This is accomplished by making the connection 94 as close to the physical center of the heating element 59 as possible so that the voltage drop from junction 94 through conductors 95 and 99 and timer drive motor 96 to neutral 72 will be essentially zero when the heating element 59 is energized.

When either the cycling thermostat 89 or high-limit thermostat 90 opens during the drying cycle, the timer motor 96 will be energized through conductor 71, centrifugal switch 93 and the second leg 98 of the heating element 59. The second coil 92 of the heating element 59 will represent a very small load of 4 or 5 ohms in series with the timer motor 96 and have a voltage drop of 1 or 2 volts. The timer motor 96 will be supplied with a voltage between 115 and 120 volts and will start and advance until the thermostat 89 or 90 closes to again effect operation of the heating element 59.

The timer motor 96 will be energized for advancement upon any deenergization of the heating circuit. For instance, if the high-limit thermostat 90 opens as in the case of an air restriction, the timer will automatically advance toward the off position.

The fabric drying apparatus will continue to operate with the heating element 59 being cycled on and off on demand of the cycling thermostat 89 which opens at a first predetermined temperature to deenergize the heating element 59 and closes again at a second predetermined lower temperature to effect reenergization of the heating element 59. This mode of operation will continue with the timer advancing during periods of heating element 59 deenergization until the timer has advanced to the off position. During periods of heating element 59 deenergization, the drive motor circuit will remain energized for continued rotation of the fabric tumbler 37 and for blower 66 operation. The timer drive motor 96 will not be deenergized until the timer has advanced to the off position.

It is clear that the circuit described hereinabove achieves a novel combination of components for improved operation of a time-and-temperature fabric dryer. The "back contacts" in the thermostat for completing circuitry to advance the timer upon interruption of the heater have been eliminated by the integration of the timer motor into the heating circuit.

In the drawings and specification there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. A fabric drying apparatus having a drying chamber and comprising: means operable for effecting drying of fabrics in said drying chamber and including an electric heating circuit; three-wire power supply means including first and second power lines and a neutral line, said heating circuit being connected across said first and second power lines and including an electric heating element having an intermediate electrical tap effectively dividing said heating circuit into first and second heater legs extending from said intermediate tap to said first and second power lines respectively; temperature sensing means effectively responsive to the temperature in said drying chamber and comprising a switch in said first heater leg operable to a nonconductive condition at a predetermined temperature for opening said first heater leg to deenergize said heating circuit; sequential control means including an electric timer motor and operable for energizing and controlling operation of said fabric drying apparatus; and timer motor circuit means for electrically connecting said timer motor between said neutral line and said intermediate tap, said timer motor having a starting voltage exceeding the voltage drop thereacross when said heating circuit is energized whereby said timer motor is not energized when said heating circuit is energized, said starting voltage being less than the voltage drop across said timer motor when said first heater leg is open whereby said timer motor is energized through said timer motor circuit means and said second heater leg when said heating circuit is deenergized, said sequential control means being operable to an off condition for deenergizing said fabric drying apparatus after a period of timer motor energization.

2. A fabric drying apparatus as defined in claim 1 wherein said temperature sensing means includes at least one normally closed thermostat.

3. A fabric drying apparatus as defined in claim 1 wherein said intermediate electrical tap is at substantially the center of said heating element.

4. A fabric drying apparatus as defined in claim 1 wherein the impedance of said timer motor is substantially greater than the resistance of said heating element.

5. A fabric drying apparatus having a fabric tumbler including a drying chamber and comprising: means operable for effecting drying of fabrics in said drying chamber including means for effecting rotation of said fabric tumbler and circulation of air through said drying chamber and further including an electric heating circuit; three wire power supply means including first and second power lines and a neutral line, said heating circuit being connected across said first and second power lines and including an electric heating element having an intermediate electrical tap effectively dividing said heating circuit into first and second heater legs having substantially equal resistances and extending from said intermediate tap to said first and second power lines respectively; temperature sensing means effectively responsive to the temperature of said circulating air in said drying chamber and comprising a switch in said first heater leg operable to a nonconductive condition at a predetermined temperature for opening said first heater leg to deenergize said heating circuit; sequential control means including an electric timer motor and operable for energizing and controlling operation of said fabric drying apparatus; and timer motor circuit means for electrically connecting said timer motor between said neutral line and said intermediate tap, said timer motor having a starting voltage exceeding the voltage drop thereacross when said heating circuit is energized through said first and second heater legs whereby said timer motor is not energized when said heating circuit is energized, said starting voltage being less than the voltage drop across said timer motor when said first heater leg of said heater circuit is open whereby said timer motor is energized through said timer motor circuit means and said second heater leg when said heating circuit is deenergized, said sequential control means being operable to an off condition for deenergizing said fabric drying apparatus after a period of timer motor energization.

6. A fabric drying apparatus as defined in claim 5 wherein said starting voltage of said timer motor is greater than 50 volts.

7. A fabric drying apparatus having a fabric tumbler including a drying chamber and comprising: a structure operable for effecting drying of fabrics in said drying chamber including an electric drive motor for effecting rotation of said fabric tumbler and circulation of air through said drying chamber and further including an electric heating circuit; a three-wire power supply including first and second power lines and a neutral line, said heating circuit being connected across said first and second power lines and including an electric heating element having an intermediate electrical tap effectively dividing said heating circuit into first and second heater legs having substantially equal resistances and extending from said intermediate tap to said first and second power lines respectively; at least one normally closed thermostat effectively responsive to the temperature of said circulating air in said drying chamber and operable to an open nonconductive condition at a predetermined temperature for opening said first heater leg to deenergize said heating circuit; a sequential controller including an electric timer motor and operable for energizing and controlling operation of said fabric drying apparatus; and a timer motor circuit for electrically connecting said timer motor between said neutral line and said intermediate tap, said timer motor having a starting voltage exceeding the voltage drop across said timer motor when said heating circuit is energized through said first and second legs whereby said timer motor is not energized when said heating circuit is energized, said starting voltage being less than the voltage drop across said timer motor when said first heater leg of said heater circuit is open whereby said timer motor is energized through said timer motor circuit and said second heater leg when said heating circuit is deenergized, said sequential controller being operable to an off condition for deenergizing said fabric drying apparatus after a predetermined period of timer motor energization.

8. A fabric drying apparatus as defined in claim 7 wherein said electric drive motor for effecting rotation of said fabric tumbler and circulation of air through said drying chamber is electrically connected across said first power line and said neutral line for operation independently of said heating circuit.

* * * * *